US012487043B2

(12) United States Patent
Balhan et al.

(10) Patent No.: US 12,487,043 B2
(45) Date of Patent: Dec. 2, 2025

(54) DEVICE FOR DISASSEMBLING A FIREARM

(71) Applicant: FN HERSTAL S.A., Herstal (BE)

(72) Inventors: Laurent Balhan, Mormont (BE); Dorian Delvaux, Vivegnis (BE)

(73) Assignee: FN HERSTAL S.A., Herstal (BE)

( * ) Notice: Subject to any disclaimer, the term of this patent is extended or adjusted under 35 U.S.C. 154(b) by 81 days.

(21) Appl. No.: 18/302,680

(22) Filed: Apr. 18, 2023

(65) Prior Publication Data

US 2023/0349655 A1 Nov. 2, 2023

(30) Foreign Application Priority Data

Apr. 28, 2022 (EP) ..... 22170641

(51) Int. Cl.
*F41A 11/00* (2006.01)
*F41A 17/34* (2006.01)

(52) U.S. Cl.
CPC ..... *F41A 11/00* (2013.01); *F41A 17/34* (2013.01)

(58) Field of Classification Search
CPC ..... F41A 11/00
See application file for complete search history.

(56) References Cited

U.S. PATENT DOCUMENTS 3,745,881 A * 7/1973 Roy ..... F41A 3/64 89/196
4,825,744 A 5/1989 Glock
7,392,611 B2 * 7/2008 Curry ..... F41A 11/00 42/108
10,429,143 B2 * 10/2019 Zajk ..... F41C 3/00
10,724,814 B2 * 7/2020 Thomele ..... F41A 17/56
10,731,935 B1 * 8/2020 Sapio ..... F41A 3/66
11,624,570 B1 * 4/2023 Rainaud ..... F41A 17/46 42/17
2015/0323274 A1 * 11/2015 Toner ..... F41A 17/56 42/70.01
2016/0377365 A1 * 12/2016 Lee ..... F41A 5/18 42/16
2017/0030673 A1 * 2/2017 Lee ..... F41A 11/00
2019/0195587 A1 * 6/2019 Thomele ..... F41A 11/00
2020/0208940 A1 * 7/2020 Maeda ..... F41B 7/08

FOREIGN PATENT DOCUMENTS

EP 2116804 A1 11/2009

OTHER PUBLICATIONS

European Patent Office, European Search Report pursuant to Rule 62 EPC, dated Oct. 17, 2022 in Patent Application No. 22170641.9, which is a foreign counterpart to this U.S. Application, to which this application claims priority.

* cited by examiner

*Primary Examiner* — Joshua E Freeman
(74) *Attorney, Agent, or Firm* — Kolitch Romano Dascenzo Gates LLC

(57) ABSTRACT

This disclosure concerns a pistol having an anti-disassembly protection device, which includes a disassembly key arranged rotatably in a frame, and which can be manually turned between an angular locking position and an angular disassembly position, and which disassembly key may occupy a transverse resting position and a transverse rotation position. The disassembly key has blocking means that cooperate with additional blocking means on the frame in order to prevent rotation of the disassembly key into the angular disassembly position when the disassembly key occupies the transverse resting position.

10 Claims, 3 Drawing Sheets

DEVICE FOR DISASSEMBLING A FIREARM

FIELD

This invention concerns a mechanism for disassembling a pistol. In particular, this invention discloses a disassembly safety device.

BACKGROUND

In the field of pistols, there are two major architectural principles related to the mechanism for disassembling the weapons.

These two major principles will be described infra in the context of a pistol operating via short barrel recoil, wherein the barrel decouples from the slide by tilting.

This operating principle is the most common in pistols. However, aspects of the present disclosure may be used for any type of pistol, whether the barrel is fixed or decouples from the slide by any type of movement.

As described, e.g., in U.S. Pat. No. 10,724,814, a first architecture consists of placing a part that can pivot about itself in front of the barrel. The function of this part is to block the forward movement of the barrel and the slide during the cycle of the weapon. In order to disassemble the weapon, then, one need only turn this part. Its asymmetrical body then allows the barrel and slide to move forward and be disengaged from the shell.

In this architecture, another element affixed to the shell is needed in order to allow the barrel to be unlocked during the recoil of the slide. This element generally takes the form of a pin or an edge.

One advantage of this solution is that it makes it possible to only permit the rotation of the disassembly lever in a given position of the slide. Indeed, a semilunar cut-out in the slide allows the lever to rotate freely. Preferably, this cut-out is arranged such that the disassembly lever can only be pivoted when the slide has been recoiled sufficiently to allow the removal of any cartridge in the chamber. The disassembly sequence thus forces the user to unload the weapon.

After pivoting the disassembly lever, the user may then push the slide forward again and remove the slide and cannon from the assembled shell. Quite often, the user must pull the trigger before they can push the moving parts beyond their 'battery position'.

If a loaded magazine is present in the weapon when the slide is moved following the rotation of the disassembly lever, a cartridge will be chambered, and the release of the firing pin will result in accidental firing.

To avoid this risk, this architectural principle may be combined with an additional part that is moved when the disassembly lever is actuated. Then, this movement (rotation or translation) is only possible if the magazine is removed from the weapon. In other words, the lever can only be pivoted if the magazine is removed from the weapon, and the slide is in the proper position, showing its semilunar cut-out opposite the disassembly lever. A mechanism of this type is described, for example, in patent application EP2116804A1.

The other major architectural principle related to disassembly is described, e.g., in U.S. Pat. No. 4,825,744. In this case, the part blocking the forward motion of the moving parts is retracted by translation rather than rotation.

There are three main advantages to the latter solution. First, and above all, a reduction in the cost price of the weapon, because this part can be made of plastic, whilst the lever described initially must be made of steel.

Secondly, the small external dimensions are less obstructive to handling. Indeed, a right-handed shooter will normally have the thumb of the weak hand on the disassembly lever. The small rotation that it can execute before coming into contact with the slide makes this support mobile, which may be awkward for the shooter. This problem does not arise with the disassembly paddle architecture.

Thirdly, the disassembly of the weapon is only possible by applying force simultaneously to both sides of the paddle. This eliminates any risk of accidental disassembly, which may occur with the disassembly lever. Indeed, when firing, if the shooter pushes on the disassembly lever, depending on grip and morphology, the lever may turn when the slide reaches the disassembly position. This prevents the firing of the next round.

Nonetheless, this architectural principle has three disadvantages compared to the lever solution.

Firstly, it does not allow the forced unloading of the weapon, because the paddle may be moved no matter the position of the slide. Thus, there is a significantly greater risk of the user accidentally leaving a round in the chamber.

Secondly, it makes disassembly less ergonomic, because it is quite difficult to translate the paddle in order to allow the barrel and slide to move. The accessible holding areas are quite small, whilst a non-negligible force must be applied in order to overcome the counter spring and the friction of the barrel as it is pushed against the paddle by the effect of the recoil spring.

Thirdly, the small translation that must be executed with the paddle in order to allow the passage of the barrel and slide considerably complicates the movement of another part that would force the removal of the magazine in order to disassemble the weapon.

SUMMARY

The present disclosure concerns a pistol comprising an anti-disassembly protection device, which includes a disassembly key arranged rotatably in a frame, and which can be manually turned between an angular locking position and an angular disassembly position, and which disassembly key may occupy a transverse resting position and a transverse rotation position, wherein the disassembly key comprises blocking means that cooperate with additional blocking means on the frame to prevent rotation of the disassembly key into the angular disassembly position when the disassembly key occupies the transverse resting position.

According to preferred embodiments, the device of the present disclosure comprises a suitable combination of one or more of the following characteristics:

- the blocking means are of the mortise-and-tenon type;
- the pistol comprises a slide sliding on a slide rail affixed to the frame between a firing position and a rear reloading position, wherein the slide, under its lower surface, comprises a housing, wherein the key comprises an eccentric tenon supported under the slide, the eccentric tenon allowing the rotation of the key only when the housing is positioned facing the eccentric tenon,
- the disassembly key comprises two index holes on which a sliding shoe (or rotating part) that is held against the lever by a spring can be supported, wherein the sliding shoe is supported on the first index hole when the disassembly key occupies the transverse resting position, and is supported on the second index hole when the disassembly key occupies the transverse rotation position.

the second index hole has a discontinuous right inner flank, preventing the extraction of the disassembly key by being supported on a right outer flank of the slide shoe when the disassembly key is in the angular locking position and allowing the extraction of the disassembly key when it is in the angular disassembly position;

the index holes are arranged on an element that is eccentric relative to the axle of the disassembly key, wherein the sliding shoe comprises a sensor that penetrates into the magazine shaft, wherein the eccentric element prevents the rotation of the disassembly key;

the sliding shoe has an inclined outer surface that allows the sliding shoe to be moved when the disassembly key is moved to its non-rotating resting position;

a barrel is affixed to the frame via the axle of the disassembly key passing into an aperture, cavity (e.g., a tubular cavity), slot, or hole disposed under the barrel.

REFERENCE NUMERALS

Figure 1:
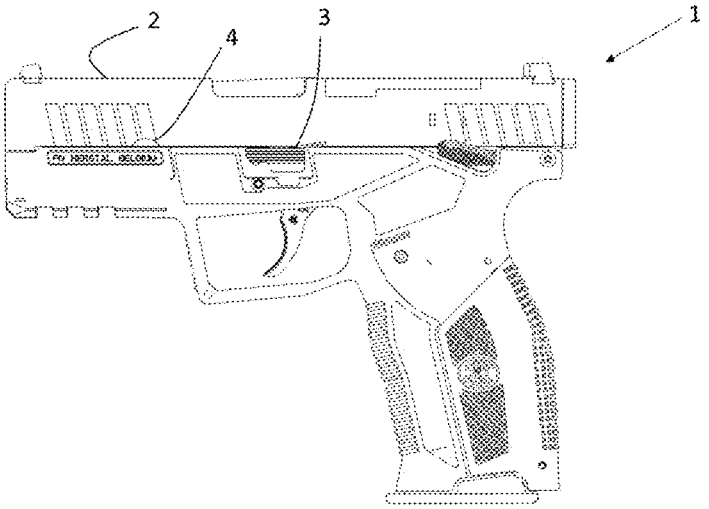
FIG. 1 shows an example of a pistol according to the present disclosure.

1. Pistol
2. Slide
3. Lever of the disassembly key
4. Housing allowing rotation of the disassembly key
5. Barrel
6. Recoil spring
7. Disassembly key
8. Safety slide shoe
9. External support surface of the slide shoe (i.e. towards the outside of the weapon)
10. Internal support surface of the slide shoe (i.e. towards the inside of the weapon)
11. First index hole
12. Second index hole
13. Tenon
14. Eccentric tenon
15. Magazine sensor
16. Counter spring of safety slide shoe
17. Shoulder of the eccentric element of the disassembly key (right inner flank, oriented towards the inside of the weapon)
18. Frame
19. Axle or elongate member of the disassembly key
20. Eccentric element of the disassembly key
21. Mortise (blocking element of the disassembly key)
22. Slide rail

DETAILED DESCRIPTION

Figure 2:
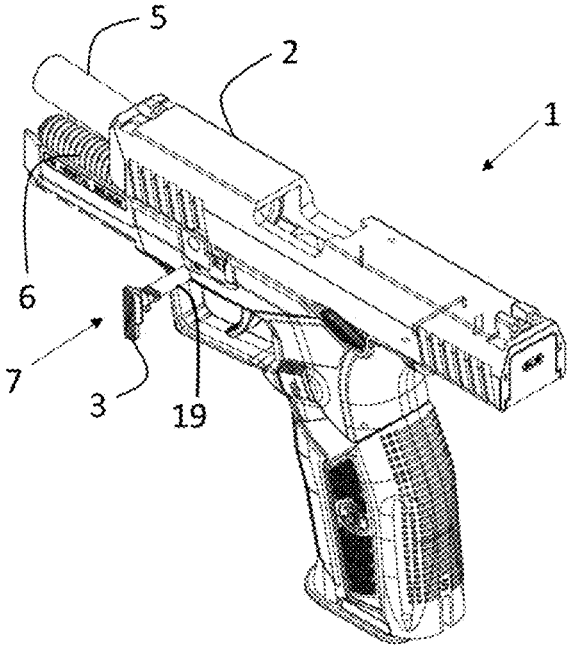
FIG. 2 shows the example pistol of FIG. 1 with the slide in the rear position and the disassembly key removed.

This invention concerns a disassembly key 7 or disassembly lever that, when it is extracted from the frame as shown in FIG. 2, allows the disassembly of the slide 2, the barrel 5, and the recoil spring 6 of an automatic pistol. To allow the extraction of the disassembly key, it must first be manually turned using the lever 3 from a blocking position into a disassembly position.

Figure 3:
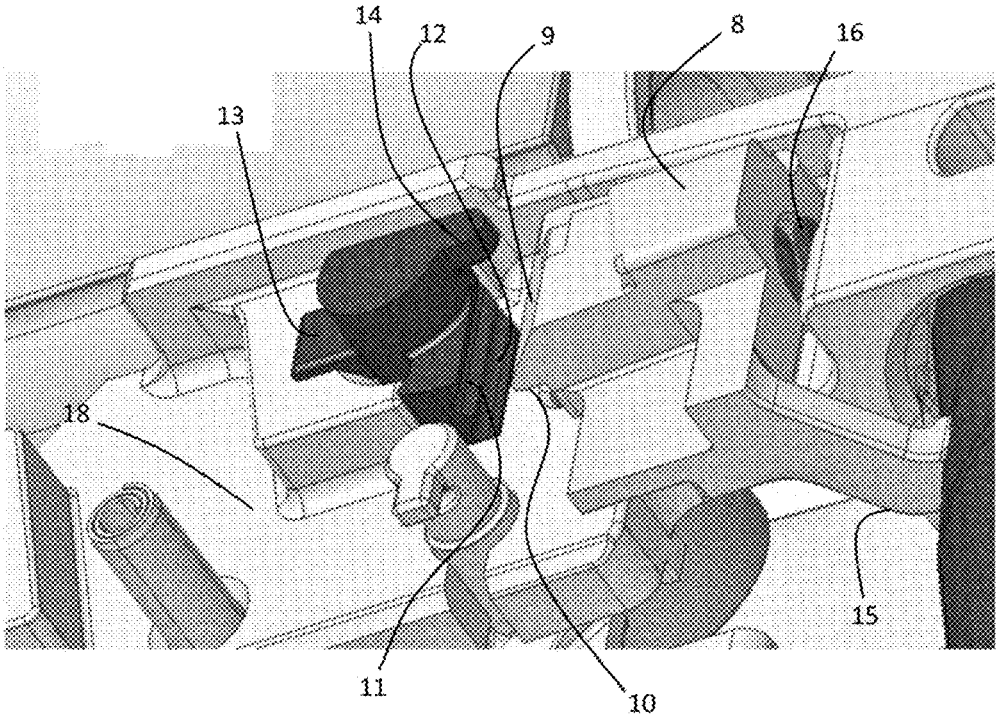
FIG. 3 shows a stripped-down view of an example of a device according to the present disclosure (here, the disassembly key is truncated and in the resting position to show the elements under the lever of the disassembly key).

To avoid angular play of the lever 3 that is perceptible to the shooter upon pressing it when the weapon is assembled, or, in particular, the accidental disassembly of the weapon during firing, the rotation of the disassembly key is blocked by the frame 18 rather than the slide. In this description, 'frame' is to be understood in the broader sense: It may be an attachment comprising the slide rails 22 and other active elements such as the ignition control device. This attachment is then integrated with a shell. It may be a metal element attached to the shell, but that does not comprise the slide rails 22, or only comprises some of them. It may also be a one-piece shell comprising the slide rails. Ideally, the blocking occurs at the level of a metal element to avoid peening and deformation. It may thus be formed on a metal element that includes, e.g. the front rails, or, as illustrated in FIG. 3, on a frame including front and rear rails. Such blocking is advantageously obtained by a tenon 13 of the disassembly key that blocks rotation in both directions by entering a mortise 21 of the frame. The rotational unlocking of the disassembly key 7 is then obtained by transversely moving the key 7 so as to cause the tenon 13 to emerge from the mortise 21.

The disassembly key preferably comprises two index holes 11, 12 oriented perpendicular to its axle (e.g., orthogonal to a long axis of the axle of the key), wherein a slide shoe 8 may occupy one or other of these holes when the disassembly key occupies the angular position in which its rotation is blocked (angular 'locking' position). This slide shoe 8 is kept in contact with the holes by suitable elastic means, such as a counter spring 16. When the disassembly key is fully pushed into its housing, with its tenon 13 placed in the corresponding mortise 21, the slide shoe is in the outermost hole 11. This transverse position is referred to as the 'resting position'. It is this position that is illustrated in FIG. 3.

When the disassembly key is pulled outward, the slide shoe 8 occupies the inner hole 12. In this position, the tenon 13 is outside the mortise 21 and allows the key to be rotated. Only then can the disassembly key be turned. This transverse position is referred to as the 'rotation position'. This position is shown, e.g., in FIG. 4.

Figure 4:
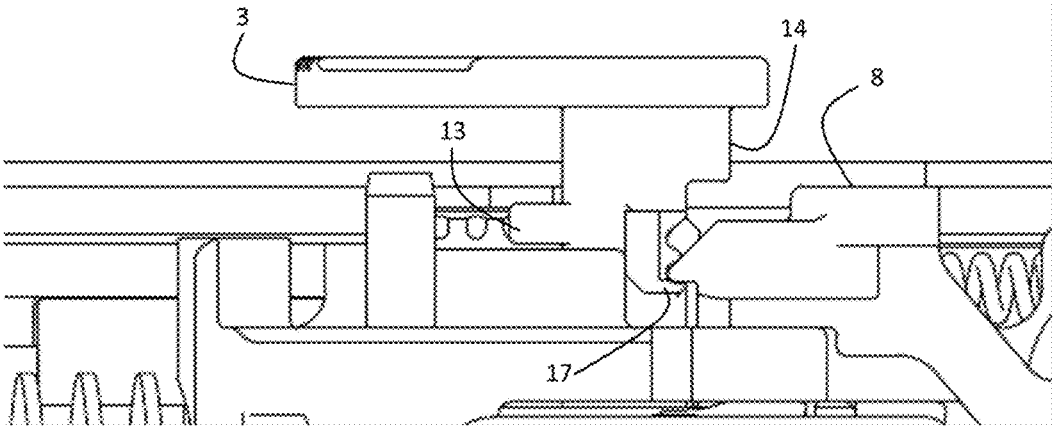
FIG. 4 shows a bottom view of an example of a device according to the present disclosure.
Figure 5:
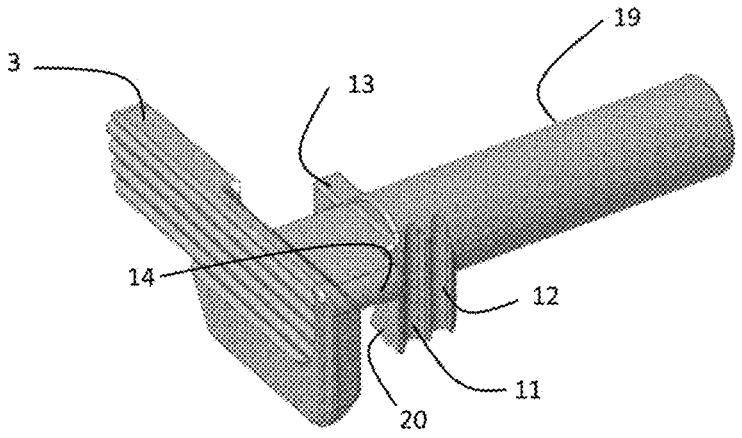
FIG. 5 shows a perspective view of an example of a disassembly key according to the present disclosure.
Figure 6:
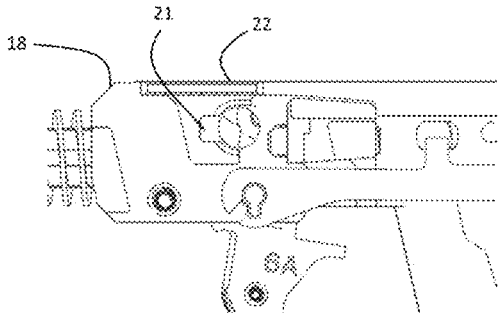
FIG. 6 shows a partial view of the frame of an example of a pistol according to the present disclosure.
Figure 7:
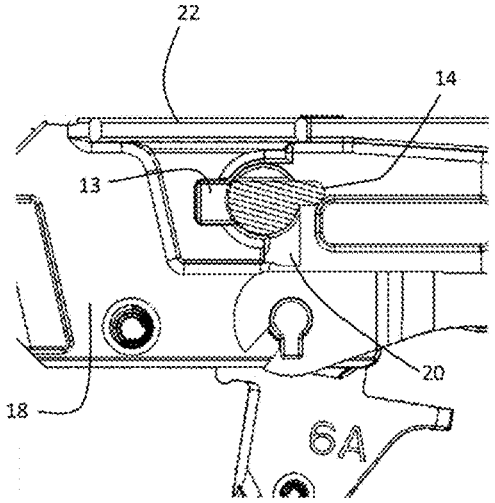
FIG. 7 shows a partial view of the frame of an example of a pistol according to the present disclosure with the disassembly key in the resting position (the disassembly key is truncated as in FIG. 3, with the hatching representing the cut of the key).

Advantageously, as shown in FIG. 4, a shoulder 17 on the disassembly key is supported on the inner surface 10 of the slide shoe and prevents further transverse extraction movement of the disassembly key 7 when the key occupies an angular locking position. The shoulder 17 is discontinuous (i.e. not present over the entire circumference of the disassembly key), such that, when the key is turned into an angular disassembly position, the shoulder 17 does not face the inner surface 10 of the slide shoe, thus allowing the complete extraction of the disassembly key 7.

In a preferred embodiment of the present disclosure, the disassembly key further allows the disassembly of the weapon to be prevented when a magazine is present in the magazine shaft. To this end, the slide shoe 8, arranged between the disassembly key 7 and the magazine shaft, comprises a magazine sensor 15. In the presence of a magazine, the sensor 15, arranged at one end of the slide shoe and able to penetrate into the magazine shaft, prevents any backward movement of the slide shoe 8. This slide shoe is then supported at its other end by an eccentric element 20 of the disassembly key 7. This eccentric element 20 is arranged on the disassembly key 7 such that, when a magazine is present, the slide shoe 8, blocked by the magazine, prevents the rotation of the disassembly key.

On the other hand, when the magazine shaft is empty, the sensor 15 is free to retract into the magazine shaft, and the eccentric element 20 pushes the slide shoe 8 backward, thus allowing the disassembly key to be rotated.

Advantageously, the disassembly key comprises a tenon 14 (or a semilunar or asymmetrical section) that is supported under the slide and prevents the rotation of the disassembly key. A housing 4 under the slide 2 allows the rotation of the disassembly key only when the slide occupies a predetermined rear position. This position preferably corresponds to the rear position when the slide is blocked by a slide stop, making it simpler to keep it in this position. This position is illustrated in FIG. 2. The presence of this tenon 14 thus makes it possible to make sure that no round is chambered, because the backward motion ensures the ejection of any round that may be present.

The disassembly procedure then comprises the following steps:

- Removal of any magazine, thus permitting the translation of the slide shoe 8;
- Recoil of the slide 2 on the slide stop;
- Partial extraction of the disassembly key 7 to extract the tenon 13 from the mortise 21;
- Rotation of the disassembly key up to a position in which the shoulder of the disassembly key no longer faces the safety slide shoe;
- Complete extraction of the disassembly key;
- Sliding the slide forward and then, depending on the type of the pistol, upward to disengage it from the frame.

Advantageously, the outer surface of the slide shoe 8 comprises an inclined outer slide surface 9, which allows the slide shoe 8 to be pushed backward when the disassembly key is inserted into its housing. It is worth noting that, in this case, the disassembly key may be replaced even if the slide is in place, in the closed-breech position. Indeed, in this case, it is not necessary to turn the disassembly key.

The following enumerated paragraphs are provided as non-limiting examples of the present disclosure.

A1. A pistol comprising an anti-disassembly protection device, which includes a disassembly key (7) arranged rotatably in a frame (18), and which can be manually turned between an angular locking position and an angular disassembly position, and which disassembly key may occupy a transverse resting position and a transverse rotation position, wherein the disassembly key (7) comprises blocking means (13) that cooperate with additional blocking means (21) on the frame in order to prevent rotation of the disassembly key (7) into the angular disassembly position when the disassembly key occupies the transverse resting position.

A2. The pistol according to paragraph A1, wherein the blocking means (13, 21) are of the mortise-and-tenon type.

A3. The pistol according to any of the foregoing paragraphs, comprising a slide (2) sliding on a slide rail (22) affixed to the frame (18) between a firing position and a rear reloading position, wherein the slide, under its lower surface, comprises a housing (4), wherein the disassembly key (7) comprises an eccentric tenon (14) supported under the slide, the eccentric tenon (14) allowing the rotation of the disassembly key (7) only when the housing (4) is positioned facing the eccentric tenon (14).

A4. The pistol (1) according to any of the foregoing paragraphs, wherein the disassembly key comprises two index holes on which a sliding shoe (8) that is held against the disassembly key by a spring (16) can be supported, wherein the sliding shoe (8) is supported on the first index hole (11) when the disassembly key occupies the transverse resting position, and is supported on the second index hole (12) when the disassembly key occupies the transverse rotation position.

A5. The pistol according to paragraph A4, wherein the second index hole (12) has a discontinuous right inner flank (17), which prevents the extraction of the disassembly key (7) by being supported on a right inner flank (10) of the sliding shoe (8) when the disassembly key is in the angular locking position, and allows the extraction of the disassembly key (7) when it is in the angular disassembly position.

A6. The pistol according to paragraph A5, wherein the index holes (11, 12) are arranged on an element (20) that is eccentric relative to the axle of the disassembly key (7), wherein the sliding shoe (8) comprises a sensor (15) that penetrates into the magazine shaft, wherein the eccentric element prevents the rotation of the disassembly key (7).

A7. The pistol according to any of paragraphs A4-A6, wherein the sliding shoe (8) has an inclined outer surface (9) that allows the sliding shoe (8) to be moved when the disassembly key (7) is moved to its non-rotating resting position.

A8. The pistol according to any of the foregoing paragraphs, wherein a barrel (5) is affixed to the frame (18) via the axle (19) of the disassembly key (7) passing into an aperture disposed under the barrel (5).

The invention claimed is:

1. A pistol comprising an anti-disassembly protection device, the anti-disassembly protection device comprising:

a disassembly key arranged rotatably in a frame, the disassembly key configured to be manually turned between an angular locking position and an angular disassembly position, wherein the disassembly key is configured to transition between a transverse resting position and a transverse rotation position, wherein the disassembly key comprises a first blocking means configured to cooperate with a second blocking means on the frame to prevent rotation of the disassembly key into the angular disassembly position when the disassembly key occupies the transverse resting position;

wherein a barrel is affixed to the frame via an axle of the disassembly key passing into a hole or a slot disposed under the barrel; and wherein the disassembly key comprises a first index hole, a second index hole, and a sliding shoe held against the disassembly key by a spring, wherein the sliding shoe is supported on the first index hole when the disassembly key occupies the transverse resting position, and is supported on the second index hole when the disassembly key occupies the transverse rotation position.

2. The pistol according to claim 1, wherein the first blocking means and the second blocking means collectively comprise a mortise and tenon arrangement.

3. The pistol according to claim 1, further comprising:

a slide configured to slide on a slide rail affixed to the frame between a firing position and a rear reloading position, wherein the slide comprises a housing under a lower surface of the slide, wherein the disassembly key comprises an eccentric tenon supported under the slide, the eccentric tenon configured to allow the rotation of the disassembly key only when the housing is positioned facing the eccentric tenon.

4. The pistol according to claim 1, wherein the second index hole has a discontinuous right inner flank, which prevents extraction of the disassembly key by being supported on a right inner flank of the sliding shoe when the disassembly key is in the angular locking position, and allows extraction of the disassembly key when the disassembly key is in the angular disassembly position.

5. The pistol according to claim 4, wherein the index holes are arranged on an eccentric element that is eccentric relative to an axle of the disassembly key, wherein the sliding shoe comprises a sensor that penetrates into a magazine shaft, and wherein the eccentric element prevents rotation of the disassembly key.

6. The pistol according to claim 1, wherein the sliding shoe has an inclined outer surface configured to allow the sliding shoe to be moved when the disassembly key is moved to the transverse resting position.

7. A pistol comprising an anti-disassembly protection device, the anti-disassembly protection device comprising:

a disassembly key arranged rotatably in a frame, the disassembly key configured to be manually turned between an angular locking position and an angular disassembly position, wherein the disassembly key is configured to transition between a transverse resting position and a transverse rotation position, wherein the disassembly key comprises a first blocking means configured to cooperate with a second blocking means on the frame to prevent rotation of the disassembly key into the angular disassembly position when the disassembly key occupies the transverse resting position; and wherein the disassembly key includes a first index hole and a second index hole, and the frame comprises a sliding shoe held against the disassembly key by a spring, wherein the sliding shoe is supported on the first index hole when the disassembly key occupies the transverse resting position, and is supported on the second index hole when the disassembly key occupies the transverse rotation position.

8. The pistol according to claim 7, wherein the second index hole has a discontinuous right inner flank, which prevents extraction of the disassembly key by being supported on a right inner flank of the sliding shoe when the disassembly key is in the angular locking position, and allows extraction of the disassembly key when the disassembly key is in the angular disassembly position.

9. The pistol according to claim 8, wherein the index holes are arranged on an eccentric element that is eccentric relative to an axle of the disassembly key, wherein the sliding shoe comprises a sensor that penetrates into a magazine shaft, and wherein the eccentric element prevents rotation of the disassembly key.

10. The pistol according to claim 7, wherein the sliding shoe has an inclined outer surface configured to allow the sliding shoe to be moved when the disassembly key is moved to the transverse resting position.

* * * * *